US005271721A

United States Patent [19]

Richards

[11] Patent Number: 5,271,721

[45] Date of Patent: Dec. 21, 1993

[54] HYDRAULIC RAM PUMPS

[75] Inventor: Ian J. Richards, Nariel via Cudgewa, Australia

[73] Assignee: Peppermint Springs Pty Ltd, Nariel via Cudgewa, Australia

[21] Appl. No.: 582,876

[22] PCT Filed: Apr. 14, 1989

[86] PCT No.: PCT/AU89/00163

§ 371 Date: Dec. 11, 1990

§ 102(e) Date: Dec. 11, 1990

[87] PCT Pub. No.: WO89/09882

PCT Pub. Date: Oct. 19, 1989

[30] Foreign Application Priority Data

Apr. 14, 1988 [AU] Australia ..... PI7751

[51] Int. Cl.[5] ..... F04F 7/02

[52] U.S. Cl. ..... 417/226

[58] Field of Search ..... 417/226

[56] References Cited

U.S. PATENT DOCUMENTS

| | | | |
|---|---|---|---|
| 868,194 | 10/1907 | Lester | 417/226 |
| 1,214,192 | 1/1917 | Lester | 417/226 |
| 1,249,462 | 12/1917 | Nilson | 417/226 |
| 1,530,182 | 3/1925 | Jordao | 417/226 |
| 1,725,637 | 8/1929 | Helmick | 417/226 |
| 4,054,399 | 10/1977 | Maurer | 417/226 |
| 4,073,604 | 2/1978 | Chen | 417/226 |
| 4,396,034 | 8/1983 | Cherniak | 137/514 |
| 4,911,613 | 3/1990 | Cox | 417/226 |

FOREIGN PATENT DOCUMENTS 424066 2/1935 United Kingdom .

OTHER PUBLICATIONS

Patent Abstracts of Japan, M-198, JP,A,57-200700 Dec. 1982, p. 15.

Patent Abstracts of Japan, M-186, JP,A,57-171100 Oct. 1982, p. 150.

*Primary Examiner*—Richard A. Bertsch
*Assistant Examiner*—Peter Koryinyk
*Attorney, Agent, or Firm*—Dvorak and Traub

[57] ABSTRACT

Hydraulic ram pump apparatus is provided, of the type including a body member (7) having a water flow passage therethrough, a waste gate (1) disposed in the passage, a delivery outlet (23) and a one-way delivery valve (10, 11) disposed in the outlet. The improvement therein lies in the waste gate (1) being pivotally mounted to the body member (7) and configured such that, in its fully open position (1*a*), the waste gate (1) does not significantly restrict the flow of water through said passage, in the interest of efficiency at low drive heads. The waste gate (1) is spring biased towards its open position to provide opening assistance to the waste gate (1) at low drive heads. The spring bias is such that it is at its greatest when the waste gate (1) is fully closed and is substantially zero when the waste gate is fully open.

2 Claims, 2 Drawing Sheets

HYDRAULIC RAM PUMPS

FIELD OF THE INVENTION

This invention relates to hydraulic apparatus.

This invention has particular but not exclusive application to hydraulic ram pumps, and for illustrative purposes reference will be made to such application. However, it is to be understood that this invention could be used in other applications, such as control apparatus using the hydraulic ram principle.

The pumping of stream, lake or reservoir water for agricultural or domestic purposes has been practiced since before recorded history. Any number of expressions of man's ingenuity have been applied to getting water from a source to a point of use. However, since there is a net energy cost in elevating water against gravity and since the potential energy of the raised water is never recovered, all means of raising the water require energy to be input. In the developed nations, the ready availability of convenient power such as electricity and internally combustible fuels has fostered a pumping technology substantially dependent on such power sources. This technology is of course completely inappropriate for use in third world or developing countries, not only from the point of view of energy supplies but also from the point of view of keeping maintenance up to the hardware.

In areas or applications where power-dependant equipment is impossible or undesirable to use, other means of supplying energy to the task of pumping must be sought. Traditionally, the art of water pumping began with the archimedean screw. This requires manual or other power for rotation and may be powered by the wind via a windmill or by water via a waterwheel or screw. The disadvantage of the archimedean screw is a severe limitation of the obtainable head, at least while retaining the apparatus' general simplicity of construction. Other simple hardware powered by wind or water includes piston pumps.

Wind powered apparatus in general have the disadvantage of being dependent upon the blowing of the wind at adequate energy flux to do useful work. Water powered apparatus are more reliable in this context but are often relatively complex and prone to mechanical failure and fouling. Waterwheels, screws and turbines are also very inefficient and at low heads need to be of very large size to make use of the available power in the water flow.

One relatively recent means of pumping utilizing the energy of a flowing stream of other water head is the use of hydraulic ram pumps. In general terms these pumps utilize the energy of water flowing through an inlet tube to close a gate across the tube. The closing of the gate creates a pressure pulse upstream of the gate, which pressure pulse exceeds the local water pressure. The tube is provided with an outlet upstream of the gate and fitted with a one-way delivery valve, such that the overpressure pulse pumps a quantity of water through the delivery valve. The delivery valve is generally air cushioned with the air supply to the air cushion being provided by a snifter valve adapted to draw air into the tube upstream of the waste gate and thence into the delivery valve. As the overpressure pulse decays the valve closes and the gate opens to allow the bulk of the water to return to the stream or outfall as waste. The cycle is then repeated at a frequency dictated by the velocity of the water flow and the configuration of the gate.

Conventional hydraulic ram pumps generally do not function at heads of less than 900 mm of water. The factors limiting low drive head performance in conventional hydraulic ram pumps include the following:

(a) A conventional waste gate generates considerable head loss, particularly when adjusted for low drive head conditions. This head loss increases the drive head necessary to produce satisfactory fluid velocities in the drive pipe.

(b) The bodies of conventional hydraulic ram pumps create considerable head loss due to a rapid change in flow direction.

(c) Conventional hydraulic ram pumps require a relatively large drive pipe "length to diameter ratio" (called L/D from here on) to operate reliably because their waste gates will not open properly with the reduced negative pressures created in hydraulic ram pumps using small L/D's at low fluid velocities. However, small drive pipe L/D's are essential in low drive head conditions to minimise head loss in the drive pipe.

(d) When operating at low drive heads, conventional hydraulic ram pumps tend to stop when impurities are caught in the waste gate or the delivery valve because the negative pressures, already low due to low fluid velocities in the pump, are reduced even further by a waste gate sealing badly. There is then insufficient negative pressure to reopen the waste gate.

(e) To obtain useful quantities of delivered fluid when operating at very low drive heads, a large volume of fluid must pass through the hydraulic ram pump. The cycle time of the hydraulic ram pump is also reduced dramatically at very low drive heads and these two factors mean a large diameter drive pipe is necessary to produce a large delivery flow per pulse. This large flow per pulse necessitates a large cross section delivery valve to reduce friction loss, but at large delivery heads the volume displaced by the moving delivery valve is comparable to the volume being pumped per pulse and the pumping efficiency becomes quite small.

(f) When operating with low drive heads, hydraulic ram pumps must be installed very close to the down stream fluid level to maximise the drive head available to the pump. This makes the air injecting valve very prone to inundation when there are small changes in the stream height. The air injecting valve is also prone to blockage due to its small cross section and the large positive pumping pressures which may force debris into the valve.

The above disadvantages are generally caused by the traditional design of the waste gate and mechanism, the delivery valve design and the perceived necessity of using a air injecting valve on the upstream side of the waste gate.

SUMMARY OF THE INVENTION

The present invention aims to alleviate the above disadvantages and to provide hydraulic ram pumping apparatus which will be reliable and efficient in use. It is a further object of the present invention to provide a hydraulic ram pump which is particularly suited for applications using head pressures at which conventional hydraulic ram pumps do not operate efficiently. Other objects and advantages of this invention will hereinafter become apparent.

With the foregoing and other objects in view, this invention in one aspect resides broadly in hydraulic ram pump apparatus of the type including:

a body member having a water flow passage therethrough;

a waste gate disposed in said passage;

a delivery outlet; and a one-way delivery valve disposed in said outlet, wherein said waste gate is configured such that, in its fully open position, the waste gate does not significantly restrict the flow of water through said passage.

Preferably, the body member comprises a substantially cylindrical housing incorporating the waste gate and the delivery outlet and valve in a single assembly. Preferably, the inlet end of the passage is connected to an inlet pipe which delivers the water to the assembly. The purpose of the inlet pipe is to set the L/D ratio discussed above, with the optimum L/D ratio being selected as the best compromise between minimum head loss (small L/D ratio) and increased waste gate opening negative pressure pulse (large L/D ratio).

The body member is preferably provided with a generally circular waste gate mounted to the body member such that the waste gate, in its fully open position, does not significantly restrict the flow of water through the passage. This is preferably achieved by providing a recess in the housing in to which the waste gate can sit in its fully open position. In the interest of efficiency at low drive heads, the waste gate is preferably pivotally mounted to the body member at this recess such that the waste gate does not significantly impede the flow of the water when the gate is in its fully open position. The recess is preferably in the form of a ramped recess having its deepest point at the downstream, pivoted end of the fully open waste gate. The waste gate is also preferably of a thickness such that the upstream edge of the waste gate is available to form a working surface for the flowing water to start to pick up the waste gate from the recess. When the waste gate is picked up from the recess, the water flow then drives the waste gate towards the closed position in a manner analogous to a conventional hydraulic ram pump.

The body member is also preferably provided with a seat to provide an impact area for the waste gate as it closes, as well as to seal the waste gate in its closed position. Again, it is preferable that the seat does not protrude significantly into the water flow path defined by the passage through the body.

The waste gate is preferably spring biased towards its open position to provide opening assistance to the waste gate at low drive heads. Preferably, the spring bias is such that it is at its greatest when the waste gate is fully closed and is substantially zero when the waste gate is fully open. The large spring bias of the waste gate towards the open position allows the waste gate to open with the very small opening negative pressures associated with small drive heads, whilst the zero spring bias applying at the fully open position permits the same small drive head to pick the waste gate out of the recess and to close the same against its seat with sufficient force to provide a positive pumping pulse.

Accordingly, in a further aspect this invention resides broadly in hydraulic ram pump apparatus of the type including:

a body member having a water flow passage therethrough;

a waste gate disposed in said passage;

a delivery outlet; and a one-way delivery valve disposed in said outlet, wherein said waste gate is biased towards its fully open position, the said bias being at its greatest when the waste gate is fully closed and substantially zero when the waste gate is fully open.

The bias is preferably provided by a spring acting between the body member and the waste gate with it being particularly preferred to use a helical spring about the pivot axis of the waste gate to prevent unnecessary interference with the flow of water through the apparatus.

The delivery outlet is preferably disposed between the body member and a delivery pipe conveying the pumped water to a point of use or storage. Preferably, the outlet is of the type having a cushioning air chamber above the outlet delivery valve to provide a compressible space, allowing water to pass into the outlet irrespective of the water condition further along the delivery pipe. The delivery valve is preferably of the type known as a disc valve and seat, wherein a disc shaped member is disposed on a circular seat an retained on the seat by gravity and back pressure, with or without spring assistance. The maximum displacement of the valve disc from its seat is preferably adjustable in order to optimize the pumping efficiency through the valve.

In a further aspect, this invention resides in hydraulic ram pump apparatus of the type including:

a body member having a water flow passage therethrough;

a waste gate disposed in said passage;

a delivery outlet; and a one-way delivery valve disposed in said outlet, wherein said one-way delivery valve is adjustable in its extent of opening to optimize pumping efficiency of the hydraulic ram pump.

Preferably, the delivery valve is of the disc type described above and the adjustment is provided by adjustably limiting the lift of the valve disc off its seat during a pumping cycle. At large drive heads the valve can be adjusted to decrease the displacement of the valve disc such that the volume displaced by the moving disc is less than the volume being pumped per pulse to improve the pumping efficiency.

The delivery outlet and valve, being preferably of the air cushioned type, must be supplied with air to replace that which inevitably passes out along a delivery pipe attached to the outlet. In the past, a air injecting valve has been provided to provide air to the body member in the region of the delivery valve, that is, upstream of the waste gate. However, these air injecting valves suffer from the disadvantage described above at (f) in that exposure to the high positive pumping pressures may force debris into the valve and effect a blockage.

Accordingly, in another aspect, this invention resides broadly in a hydraulic ram pump apparatus of the type including:

a body member having a water flow passage therethrough;

a waste gate disposed in said passage;

a delivery outlet positioned upstream of said waste gate;

a one-way delivery valve disposed in said outlet; and a air injecting valve supplying cushioning air to said one-way delivery valve, wherein said air injecting valve is located downstream of said waste gate such that air is drawn through said air injecting valve and into the body member upstream of said waste gate during the opening phase of said waste gate.

Preferably, the air injecting valve consists of a small orifice which passes from outside the pump body to the point in the waste fluid flow downstream from the waste gate seat.

Since the pressure downstream of the waste gate is always lower than the peak pressure upstream of the waste gate, the air injecting valve is never subjected to the pumping pressures which was the primary cause of blockage in the prior art apparatus. The air injecting valve is preferably of a size to maintain an adequate air supply to the delivery valve for cushioning purposes without providing so much that the apparatus gas locks. The size of the air injecting valve is determined by experiment in individual apparatus, if desired the air injecting valve may be adjustable.

The downstream waste outlet of the apparatus preferably takes the form of a descending waste pipe which extends down to below the water level downstream of the apparatus. Such an arrangement provides for the creation of a siphon effect assisting acceleration of the waste gate to its fully closed position and accordingly increasing the pump pulse peak pressure. A second advantage of this configuration is that the siphon connection with the downstream water level prevents uncontrolled entry of air into the apparatus and thus prevents vapour locking of the apparatus.

BRIEF DESCRIPTION OF THE DRAWINGS

In order that this invention may be more easily understood and put into practical effect, reference will now be made to the accompanying drawings which illustrate a preferred embodiment of the invention, wherein.

DETAILED DESCRIPTION OF THE INVENTION

Figure 1:
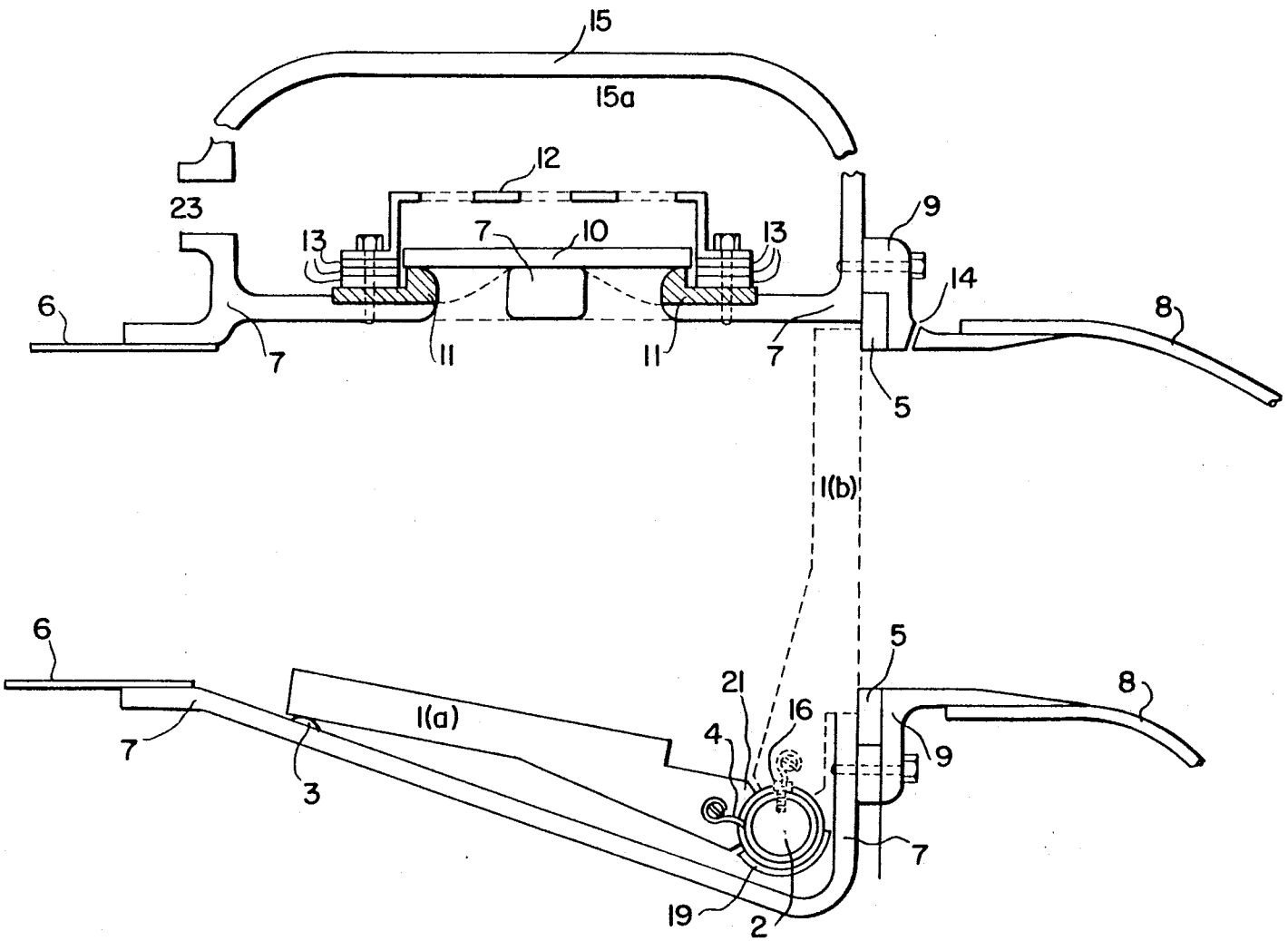
FIG. 1 is a side view in vertical section of apparatus in accordance with the present invention.
Figure 2:
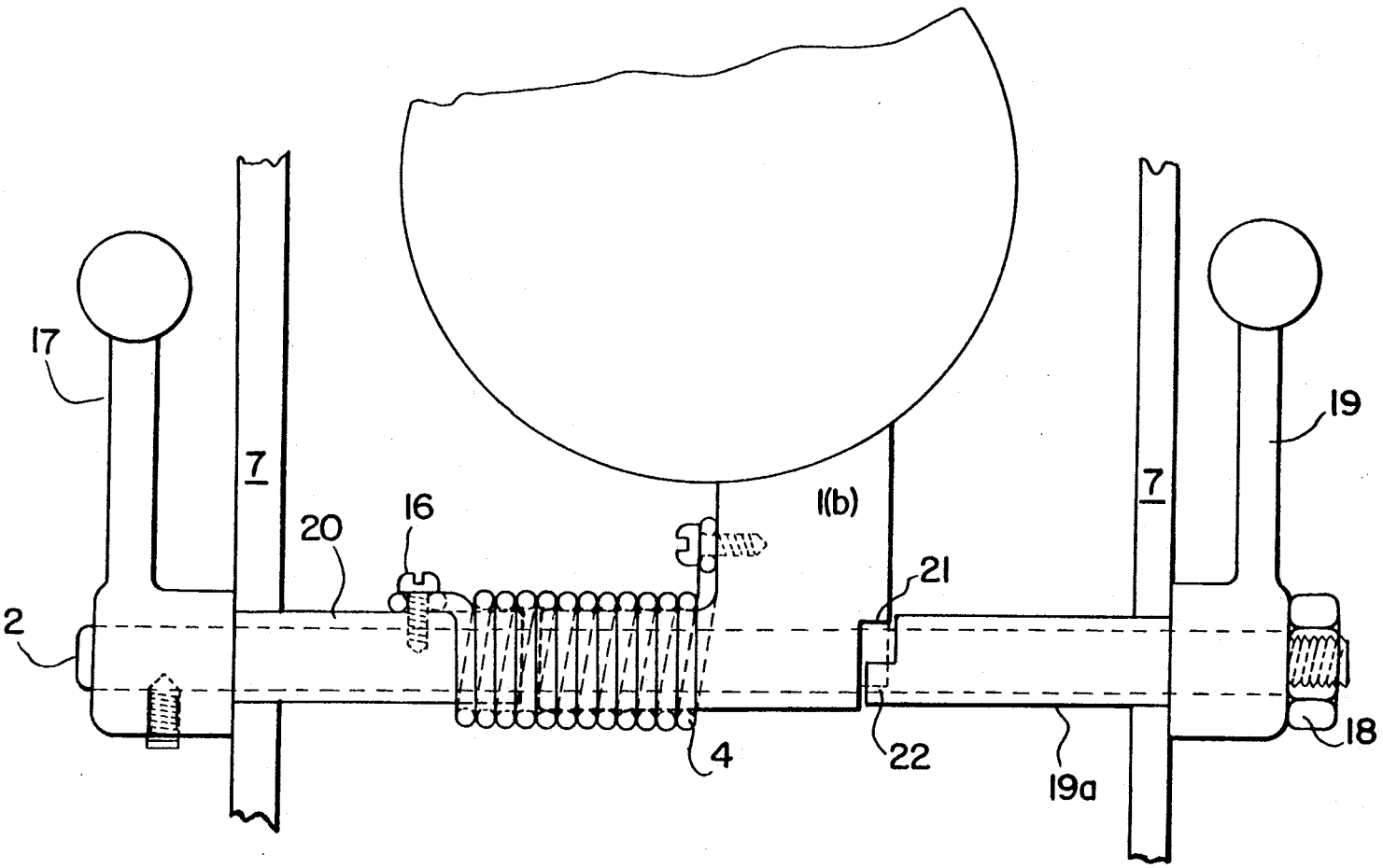
FIG. 2 is a front view in vertical section of the apparatus of FIG. 1.

In the FIGURES, a hydraulic ram pump assembly is provided having a waste gate 1 illustrated in its fully open position 1*a* and illustrated in its fully closed position 1*b*. The waste gate 1 is pivotally mounted on a shaft 2 located transverse to and out of the direct line of the water flow. The waste gate 1 is biased towards its fully open position by spring 4 coaxial with the shaft 2. The waste gate 1 is adapted to seal in its fully closed position against annular seal ring 5. The water is supplied to the apparatus via feed pipe 6 attached to the inlet side of housing 7. The waste gate 1 in its fully open position rests in recess 7*a* in the lower portion of the housing 7, which recess also accommodates the shaft 2 and the spring 4. The waste side of the housing 7 is terminated by an annular seal housing 9 adapted to retain the seal 5 as well as to mount waste outlet pipe 8. The seal housing 9, seal 5 and waste pipe 8 are of a diameter similar to that of the inlet pipe 6 such that the flow of water is not significantly impeded. The waste pipe 8 is curved down to the downstream water level to provide a siphon to assist the water hammer action of the apparatus to open and close the waste gate 1.

The upper portion of the housing 7 upstream of the waste gate 1 is provided with a delivery outlet comprising apertures in the housing 7. The apertures are closed by a delivery valve comprised of a valve disc 10 adapted to seal against seal 11. The displacement of the valve disc 10 on the pump stroke is limited by stop 12 which is adjustable via selectable spacers 13. The delivery valve is housed in housing extension 15 formed integrally with the housing 7. The housing extension 15 defines an air space 15*a* which provides elastic cushioning of the pump. The valve housing 15 is provided with a delivery port 23 to which a delivery pipe can be attached. The cushioning air for the valve is supplied by air injecting valve 14 located downstream of the waste gate 1. The air injecting valve 14 consists of a small orifice which passes from outside the pump body to the point in the waste fluid flow downstream from the waste gate seat.

The shaft 2 is mounted to the housing 7 via shaft sleeve 20. The shaft sleeve 20 also provides a mounting point for the spring 4 at 16. The effective spring tension is controlled by rotation of the shaft 2 and sleeve 20 assembly relative to the waste gate 1 extension to the shaft 2. This relative rotation is effected by rotation of control lever 17 attached to the shaft 2. Start and stop control of the assembly is provided by start/stop lever 19 acting on sleeve 19*a* which is provide with gate opening lug 22. A gate closing lug 21 is provided on the waste gate 1. The position of the lever 19 is retained as desired by lock nut 18.

The open waste gate 1(*a*) is nearly in balance in the position shown with the combined forces of gate 1(*a*) buoyancy and spring 4 torsion nearly balancing the gravitational force acting on the gate 1(*a*). In this position the open gate 1(*a*) rests lightly against gate stop 3 and creates very little head loss. As the fluid velocity passing the leading edge of gate 1(*a*) from drive pipe 6 reaches a point where the pressure and viscous forces acting on the gate 1(*a*) overcome all other forces acting on the gate 1(*a*), the gate 1(*a*) begins to close. (the sum of spring 4 torsion, buoyancy and gravitational forces acting on the gate is defined as the gate opening force and hereinafter called $F_o$).

The gate 1(*a*) rotates clockwise about gate pivot shaft 2 and as the gate 1(*a,b*) projects further into the fluid flow the increasing pressure and viscous forces more than cope with the increasing $F_o$ and the gate 1(*a,b*) quickly accelerates up to the velocity of the water.

When the waste gate 1(*a,b*) reaches the closed position, the gate opening force $F_o$ has increased significantly because the spring 4 which was acting to close the gate 1(*b*) when the gate 1(*a*) was open, is now acting with the negative pressure pulse to open the gate 1(*b*), and the gravitational and buoyancy forces acting to open the gate 1(*b*) have dropped to almost zero.

This large value of gate opening force $F_o$ when the gate 1(*b*) is closed enables the gate 1(*b*) to swing open with only very small negative pressures associated with operating the pump at small L/D's and/or sealing problems due to debris caught between the gate 1(*b*) and the waste gate seat 5.

Waste tube 8 carries the fluid which has passed through the pump waste outlet 9 in a large radius to the downstream fluid level. The waste tube 8 is either immersed under the down stream fluid or has its open end tilted back. This traps fluid in the waste tube 8 and prevents gas entering the pump body 7.

The waste tube 8 also acts as a siphon and applies most of the pressure difference between the upstream and downstream fluid level across the drive pipe 6. Consequently, the hydraulic ram pump may be mounted as high as the upstream fluid level and away from potential flooding.

The delivery valve disc 10 deals against the valve seat 11 and is constrained in its movement by valve stop 12.

The volume of fluid displaced by valve disc 10 when it opens is determined by the distance between the top of the valve disc 10 and the bottom of the valve stop 12. This distance may be adjusted by changing the thickness of the spacers 13 to optimise the delivery efficiency of the hydraulic ram pump at different delivery heads.

Air injecting valve 14 injects gas into the downstream side of the waste gate seat 5 because there is always negative pressure inside the pump waste outlet 9.

This negative pressure is normally small due to the siphon effect of the waste tube 8 and momentarily large due to the negative water hammer effect when the waste gate 1(*b*) closes.

When the waste gate 1(*a,b*) opens after a pumping cycle, the reverse flow of water through the pump waste outlet 9 carries some of the injected gas into the roof of the pump body 7 where it is subsequently carried into the air chamber 15 during the following pumping cycle.

One end of spring 4 is rigidly connected to control lever 17 by spring clamp 16 which clamps spring 4 to the pivot shaft 2 through shaft sleeve 20. The position of control lever 17 and consequently, spring clamp 16 determines the maximum value of $F_o$. The force $F_o$ acting on the gate 1(*a,b*) may be adjusted by moving control lever 17 to suit specific pumping conditions. When control lever 17 is correctly adjusted, lock nut 18 may be tightened to prevent control lever 17 from moving.

Because all moving parts of the low drive head hydraulic ram pump are not directly accessible, it is necessary to provide a means of opening and closing the gate 1(*a,b*) from outside the pump body 7.

This is necessary to manually pump air out of the pump body 7 if the hydraulic ram pump has been stopped for any length of time.

When lock nut 18 is loose, rotation of start/stop lever 19 past the point where it contacts gate opening lug 21 causes the gate 1(*a,b*) to open. If start/stop lever 19 is rotated in the opposite direction past the point where it contacts gate closing lug 22, the gate 1(*a,b*) may be forced to close.

It will of course be realised that while the above has been given by way of illustrative example of this invention, all such and other modifications and variations thereto as would be apparent to persons skilled in the art are deemed to fall within the broad scope and ambit of this invention as defined in the claims appendant hereto.

I claim:

1. A hydraulic ram pump apparatus comprising:

a body member having a water flow passage therethrough;

a waste gate pivotally mounted in said passage and being movable between an open position wherein water may flow past said waste gate and a closed position wherein said waste gate substantially closes said flow passage;

a delivery outlet having a non-return valve therein and located upstream of said waste gate, said delivery outlet having an air chamber having air compressed by the passage of water delivered to said air chamber through said non-return valve, said air being supplied through an air injection valve located downstream of said waste gate and into said body member upstream of said waste gate during the opening of said waste gate; and a waste water outlet downstream of said waste gate; and gate biased away from the closed position, the bias being greatest when the waste gate is closed and the bias being substantially non-existent when said waste gate is open.

2. The hydraulic ram pump of claim 1 wherein said air injection valve comprises an orifice communicating with the fluid flow to atmosphere, said orifice providing a valve action due to the relative velocities of air and water.

* * * * *